US008292134B2

(12) United States Patent
Lin

(10) Patent No.: US 8,292,134 B2
(45) Date of Patent: Oct. 23, 2012

(54) MULTIFUNCTION CLOTHES HANGER

(76) Inventor: Kuo-Chi Lin, Xinzhuang (TW)

( * ) Notice: Subject to any disclaimer, the term of this patent is extended or adjusted under 35 U.S.C. 154(b) by 182 days.

(21) Appl. No.: 12/959,428

(22) Filed: Dec. 3, 2010

(65) Prior Publication Data

US 2012/0138640 A1 Jun. 7, 2012

(51) Int. Cl.
*A41D 27/22* (2006.01)

(52) U.S. Cl. ..... 223/89; 223/85; 223/88

(58) Field of Classification Search ..... 223/85, 223/88, 89, 92, 94, 95, DIG. 4; 211/85.3
See application file for complete search history.

(56) References Cited

U.S. PATENT DOCUMENTS 3,584,746 A * 6/1971 Marchman ..... 223/85
4,058,222 A * 11/1977 Singer ..... 223/92
5,007,562 A * 4/1991 Brink et al. ..... 223/89
5,065,915 A * 11/1991 Rosch ..... 223/89
5,577,644 A * 11/1996 Chen ..... 223/85
5,645,200 A * 7/1997 McDowell et al. ..... 223/89
5,901,888 A * 5/1999 Schneider et al. ..... 223/89
6,202,905 B1 * 3/2001 Heide ..... 223/88
6,409,057 B1 * 6/2002 Kim ..... 223/85
6,758,378 B2 * 7/2004 Carmichael ..... 223/85

* cited by examiner

*Primary Examiner* — Nathan Durham

(57) ABSTRACT

A multifunction clothes hanger includes a main body, a hook, an annular member and two clothes hangers. A protrusion of a cylindrical body of each clothes hanger enters a T-shaped through-groove at the bottom of the main body and moves into a transverse portion of the T-shaped through-groove to enter left and right through-holes of the main body. The protrusion is engaged with grooves disposed on the inner sides of the left and right through-holes, respectively. Furthermore, the hook is inserted into a straight through-hole at the upper portion of the main body until the threaded bottom with a thread thereon reaches the bottom of the main body to engage with a screw nut of the annular member. Another space-saving multifunction clothes hanger further includes a fixing base, upper and lower arms, two grooves, left and right baffles and two screw holes.

8 Claims, 7 Drawing Sheets

MULTIFUNCTION CLOTHES HANGER

BACKGROUND OF THE INVENTION

1. Field of the Invention

The present invention relates to multifunction clothes hangers, and more particularly, to a multifunction clothes hanger which is quick to assemble, quick to disassemble, and convenient to carry.

2. Related Art

A known way of sun drying or air drying quilts, large clothes, or underwear entails hanging them on clothes hangers or bamboo poles for sun drying or air drying. However, doing so in a small space is not easy.

It is inconvenient to sun dry or air dry one's clothes or large personal articles during business trips or family vacation trips. This is particularly true when traveling with a child or baby, because its clothes, blankets, or quilts are likely to get dirty or wet and therefore have to be sun dried or air dried, thereby spoiling the pleasure of the family vacation trips.

The inventor of the present invention often travels abroad on business and thus finds it inconvenient to dry clothes that are inadvertently wetted during a trip. Hence, the inventor devises a multifunction clothes hanger of the present invention.

SUMMARY OF THE INVENTION

One objective of the invention herein is to provide a multifunction clothes hanger having a main body, a hook, an annular member and two clothes hangers. A straight through-hole is centrally disposed in the main body, and left and right through-holes as well as a T-shaped through-groove are formed therein. A curved crotchet is disposed at the upper end of the hook; a thread is disposed at the bottom thereof. The annular member is a ring-shaped body and a screw nut is disposed on the top of the ring-shaped body. The clothes hangers include a cylindrical body, two rings and a resilient cord. A protrusion of the cylindrical body of each clothes hanger enters the T-shaped through-groove at the bottom of the main body and moves into a transverse portion of the T-shaped through-groove to enter left and right through-holes of the main body. The protrusion of each clothes hanger is engaged with the grooves disposed on the inner sides of the left and right through-holes, respectively. Furthermore, the hook is inserted into the straight through-hole at the upper portion of the main body until the thread at the bottom of the hook reaches the bottom of the main body to engage with the screw nut of the annular member so as to assemble the first multifunction clothes hanger.

Another space-saving multifunction clothes hanger in the second preferred embodiment comprises a main body, a hook, an annular member, two clothes hangers and a fixing base. Actually, the basic structure of the second embodiment is the same as the preceding embodiment in terms of structure; while this preferred embodiment further includes a fixing base, upper and lower arms, upper and lower grooves, left and right baffles and two screw holes. The main body of the multifunction clothes hanger of the present invention enters the fixing base by passing the upper and lower grooves such that the main body becomes engaged with the left and right baffles. Afterward, a screw is passed through each of the screw holes and fixed to the main body. As a result of the angular adjustment and the ensuing firm engagement between the protrusion of each of two clothes hangers and the grooves of the main body, two clothes hangers can be rotated in a manner that the clothes hangers lie on the same side with one above the other, thereby finalizing the multifunction clothes hanger in this preferred embodiment.

The multifunction clothes hanger is advantageously quick to assemble, quick to disassemble, and convenient to carry, and thus is especially useful in outdoor activities or outings during which large personal articles or underwear can be put on the multifunction clothes hanger for sun drying or air drying. Also, the multifunction clothes hanger of the present invention minimizes the space required for sun drying or air drying by using vertical 3D space efficiently to thereby make good use of limited space.

BRIEF DESCRIPTION OF THE DRAWINGS

FIG. 7-1 is a schematic view of a fixing base of the present invention.

DETAILED DESCRIPTION OF THE PREFERRED EMBODIMENTS

Figure 1:
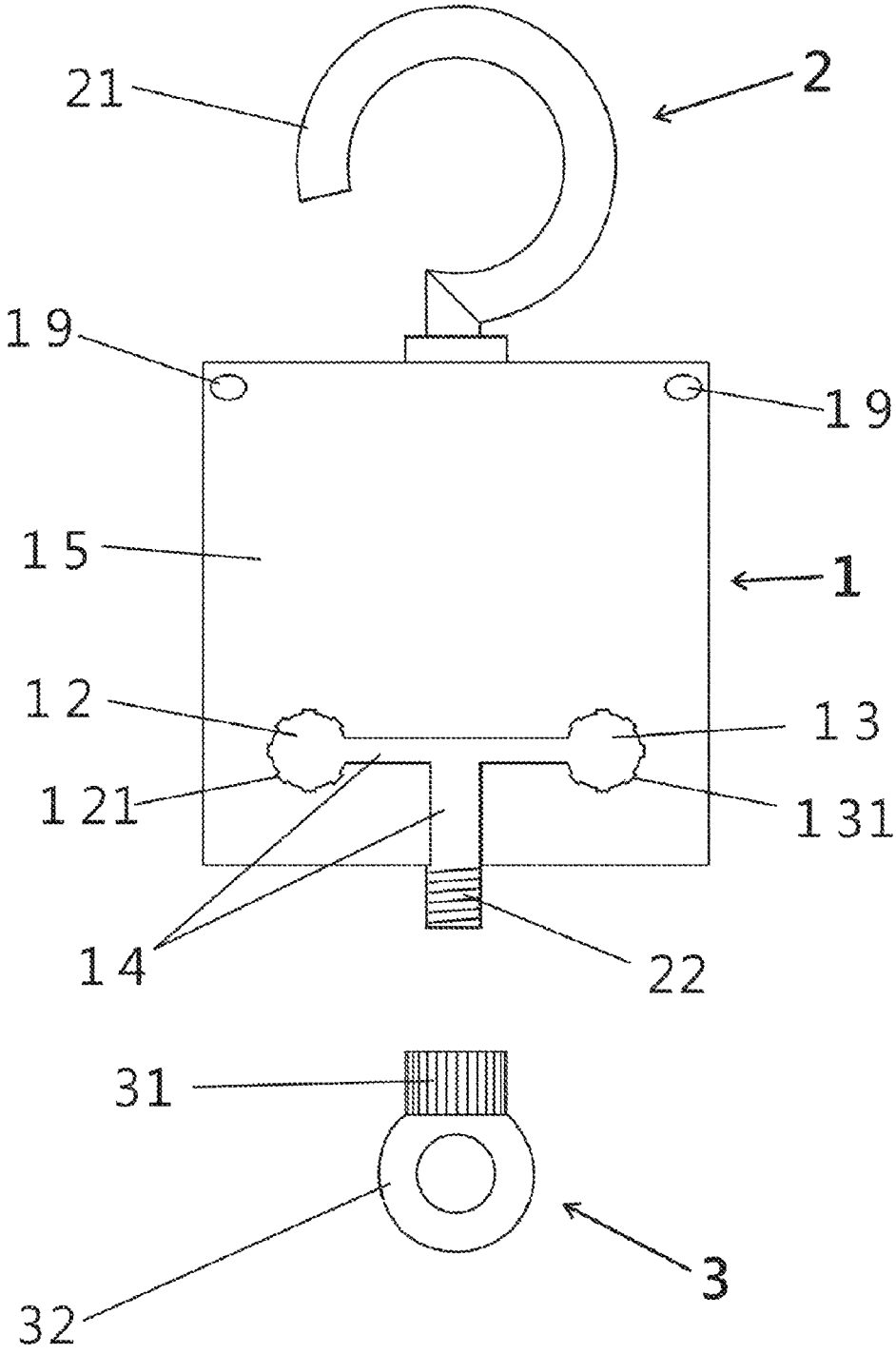
FIG. 1 is a side view of a multifunction clothes hanger according to the present invention.
Figure 2:
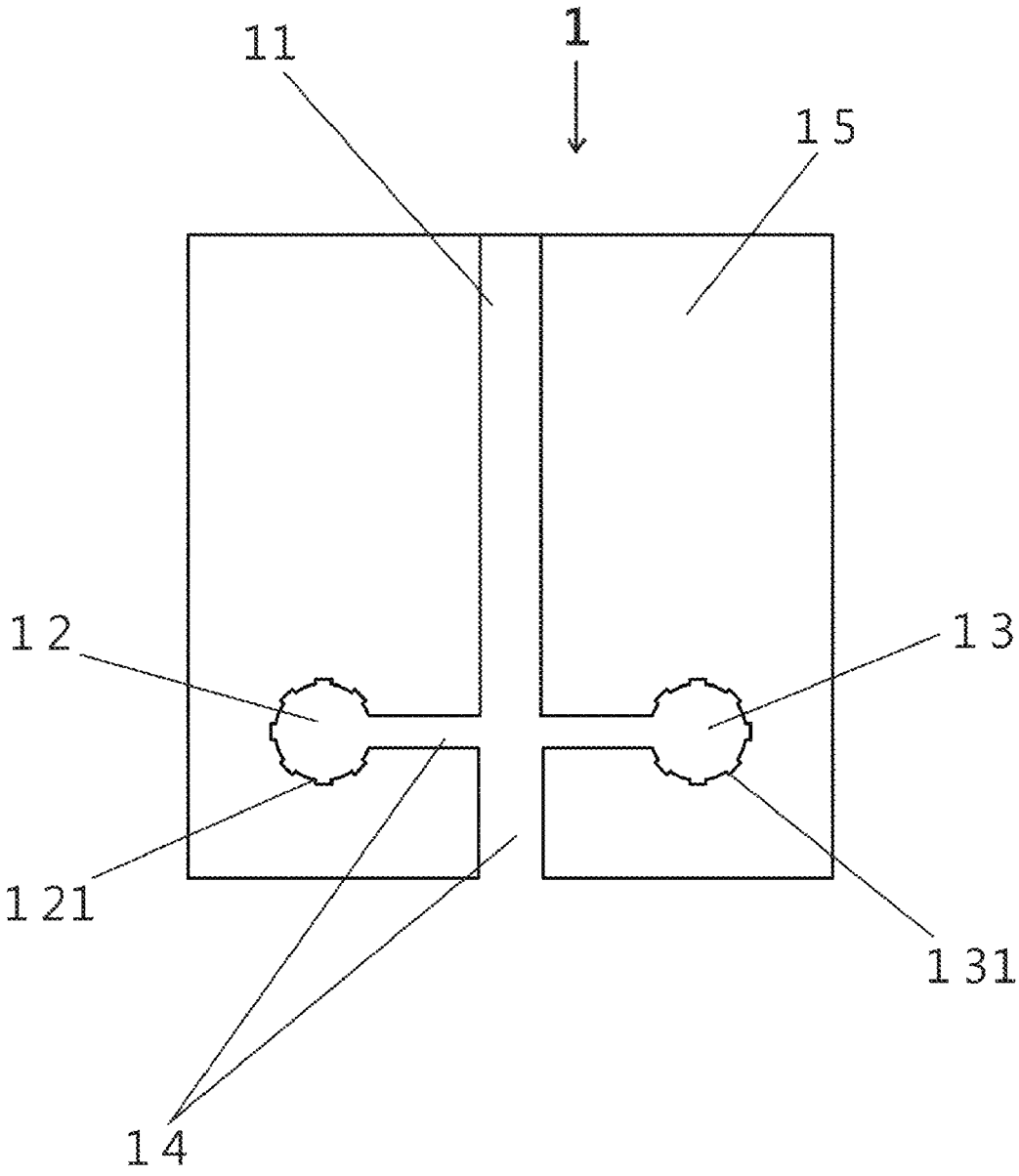
FIG. 2 is a cross-sectional view of a main body of the present invention.
Figure 3:
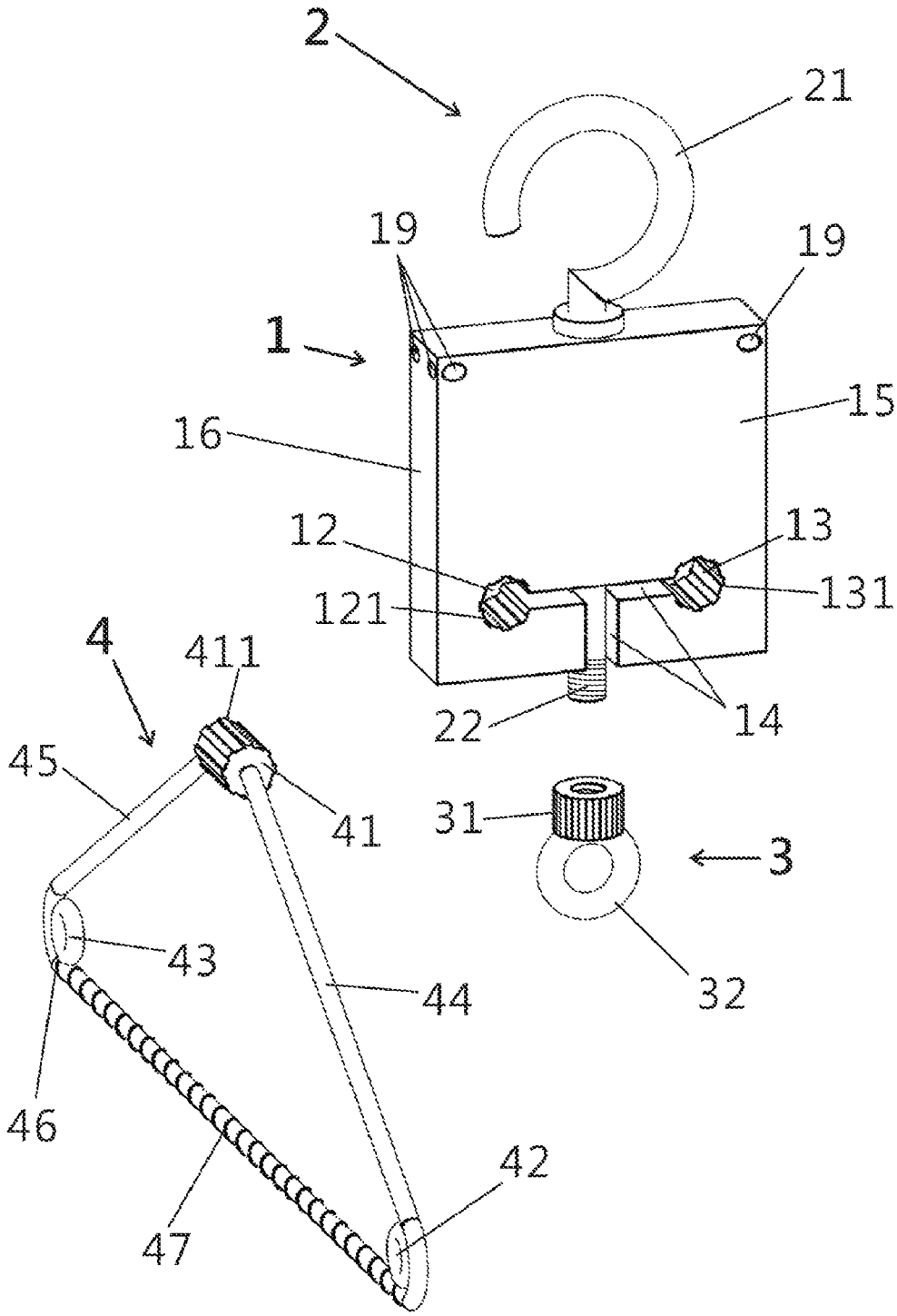
FIG. 3 is an exploded perspective view of the present invention.
Figure 4:
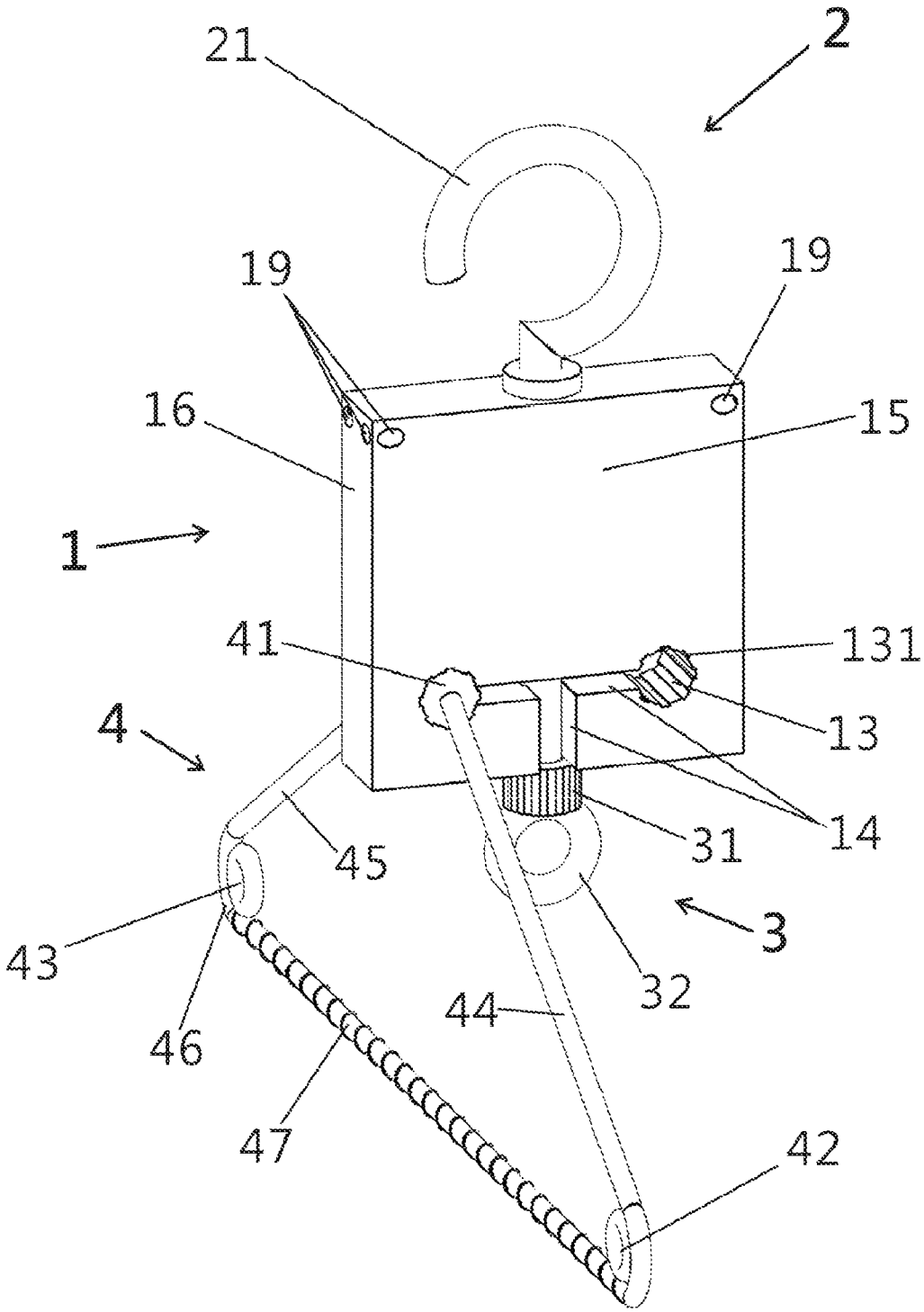
FIG. 4 is a perspective view of the present invention.

Referring to FIGS. 1, 2, 3 and 4, there are shown a side view, a cross-sectional view, an exploded perspective view, and a perspective view of a multifunction clothes hanger of the present invention, respectively. As shown in the drawings, the multifunction clothes hanger of the present invention comprises a main body 1, a hook 2, an annular member 3, and two clothes hangers 4. The main body 1 is a hexahedron. A straight through-hole 11 is centrally disposed in the main body 1 to penetrate the main body 1 from the top of the main body 1 to the bottom thereof. Left and right through-holes 12, 13 are disposed on a lateral side 15 of the main body 1. Grooves 121, 131 are disposed on the inner sides of the left and right through-holes 12, 13, respectively. The grooves 121, 131 of the main body 1 can be rotatably engaged with a protrusion 411 disposed on the outer surface of a cylindrical body 41 of each of the clothes hangers 4 in a manner that the rotatable engagement between the protrusion 411 and the grooves 121, 131 is further tightened according to the directional and angular adjustment by a user.

To enable the protrusion 411 of each of the clothes hangers 4 to be received in and engaged with the left and right through-holes 12, 13 of the main body 1, it is feasible for a T-shaped through-groove 14 to extend from the bottom of the straight through-hole 11 of the main body 1 to between the left and right through-holes 12, 13. The longitudinal portion of the T-shaped through-groove 14 completely penetrates the main body 1, extends to between the left and right through-holes 12, 13, and starts therefrom to penetrate transversely. Hence, the protrusion 411 of the cylindrical body 41 of each of two said clothes hangers 4 enters the straight through-hole 11 and the T-shaped through-groove 14 at the bottom of the main body 1 smoothly. To be specific, the protrusion 411 of the cylindrical body 41 of each of the clothes hangers 4 enters the T-shaped through-groove 14 at the bottom of the main body 1, moves along the T-shaped through-groove 14 to reach the upper portion of the T-shaped through-groove 14, and moves into the transverse portion of the T-shaped through-groove 14 to enter the left and right through-holes 12, 13. As a result, the protrusion 411 of the cylindrical body 41 of each of the clothes hangers 4 is engaged with the grooves 121, 131 disposed on the inner sides of the left and right through-holes 12, 13, respectively. Furthermore, two said clothes hangers 4 can be stretched and spread to be positioned at an appropriate angle as needed, such that two said clothes hangers 4 have access to sufficient ventilation space and thereby speed up the sun drying or air drying of articles.

Figure 5:
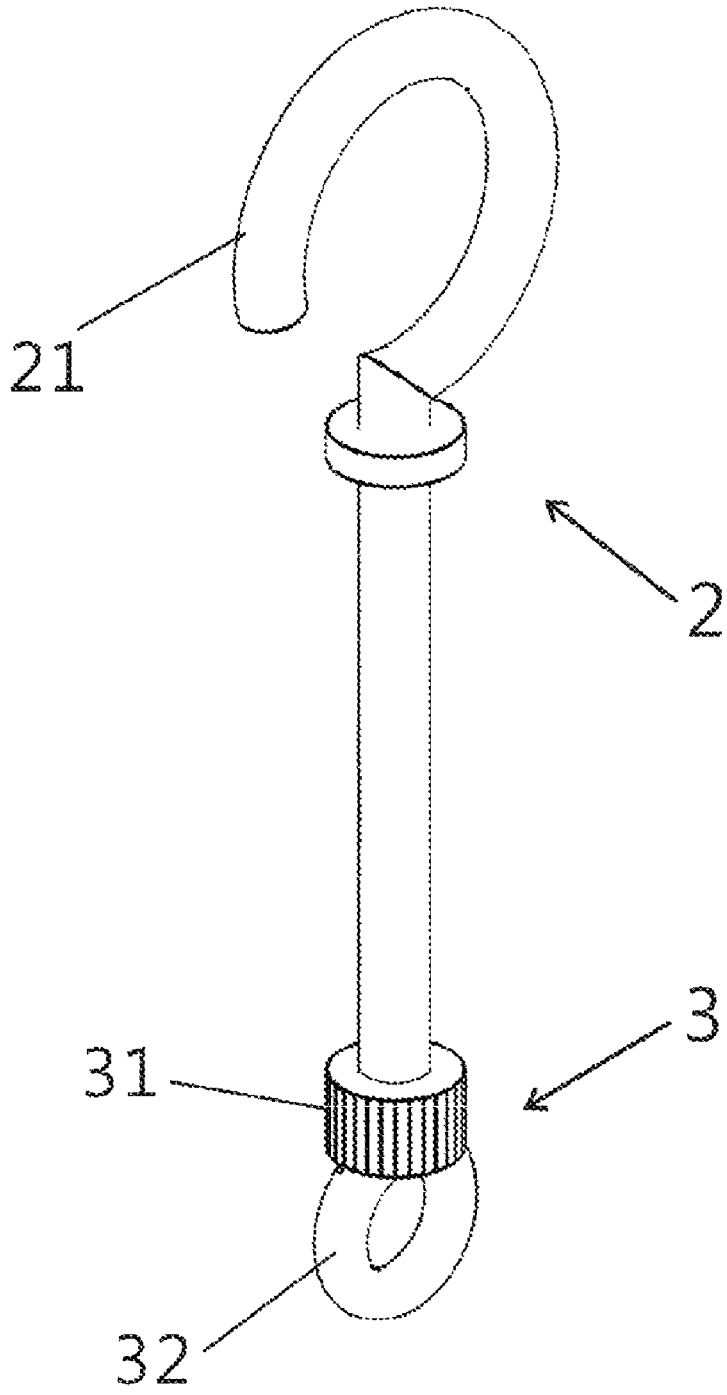
FIG. 5 is a front view of a hook and an annular member of the multifunction clothes hanger.

The illustration in FIG. 5 shows a front view of a hook and an annular member of the multifunction clothes hanger. A curved crotchet 21 is disposed at the upper end of the hook 2. A thread 22 (shown in FIGS. 1 and 3) is disposed at the bottom of the hook 2. The threaded bottom (with the thread 22 thereon) of the hook 2 is inserted into the straight through-hole 11 at the upper portion of the main body 1 until the threaded bottom with the thread 22 thereon reaches the bottom of the main body 1 to engage with a screw nut 31 of the annular member 3; in so doing, the thread 22 and the screw nut 31 are locked with each other to thereby couple together the hook 2 and the annular member 3 of the multifunction clothes hanger. The annular member 3 further comprises a ring-shaped body 32 capable of free rotation and angular adjustment. The ring-shaped body 32 is applicable to hang another multifunction clothes hanger.

Figure 6:
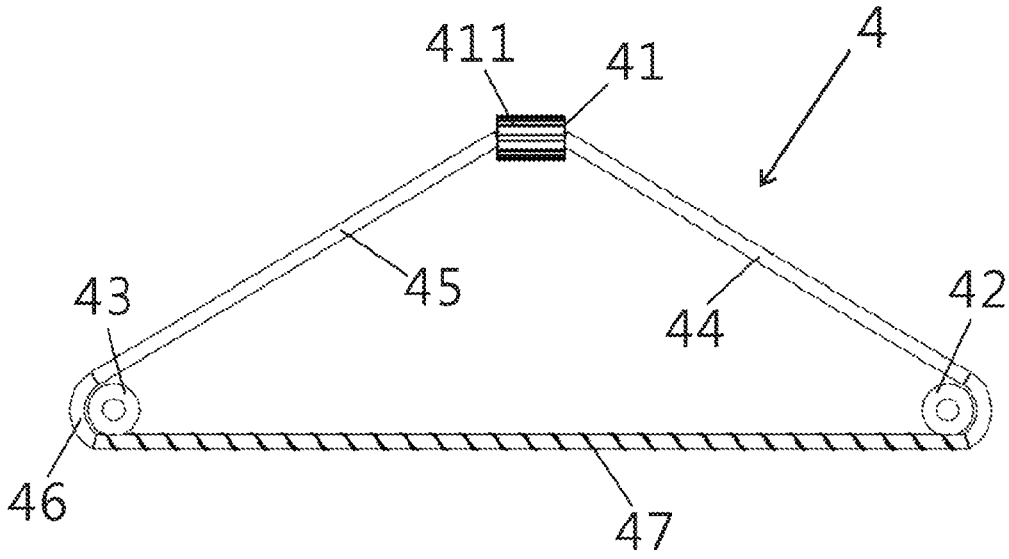
FIG. 6 is a front view of a clothes hanger of the present invention.

FIG. 6 is a front view of the clothes hanger 4 of the multifunction clothes hanger of the present invention. As shown in the drawing, the clothes hanger 4 comprises a cylindrical body 41, two rings 42, 43, and a resilient cord 47. The cylindrical body 41 is disposed between two slope portions 44, 45 of the clothes hangers 4. The protrusion 411 is disposed on the outer surface of the cylindrical body 41. Two said rings 42, 43 are disposed at two corners between a base side 46 and two said slope portions 44, 45 of the clothes hanger 4, respectively. The resilient cord 47 is fixed to one of two said rings 42, 43, extended along the base side 46 while winding around the base side 46 to reach the other one of two said rings 42, 43, and fastened to the other one of two said rings 42, 43 so as to render the resilient cord 47 taut. Referring to FIG. 4 again, four through-holes 19 are disposed at the upper end of left and right sides of the main body 1, respectively; each of said through-holes 19 penetrates the main body 1 from a side 15 thereof to an adjoining side 16. Personal paraphernalia, such as handkerchiefs, socks, mantillas, scarves, or underwear, can be held by the resilient cord 47 winding around the base side 46 and thereby hung on the base side 46 for sun drying or air drying. Alternatively, it is feasible to stretch a portion of the resilient cord 47 fastened to one of two said rings 42, 43 and slacken the other portion of the resilient cord 47 fastened to the other one of two said rings 42, 43, such that the slackened other portion of the resilient cord 47 fastened to the other one of two said rings 42, 43 no longer winds around the base side 46. The aforesaid alternative use of the multifunction clothes hanger is useful in sun drying or air drying large articles, such as large jackets, quilt covers, bed sheets, or quilts, which are heavy and thus likely to droop or fall. To fix the large articles to the multifunction clothes hanger for stable sun drying or air drying, it is feasible for the slackened and unwinding portion of the resilient cord 47 to be pulled toward the through-holes 19 of the main body 1, passed through the through-holes 19, and fastened to the through-holes 19 before the resilient cord 47 is pulled toward the other ring and fastened thereto.

Figures 1, 7:
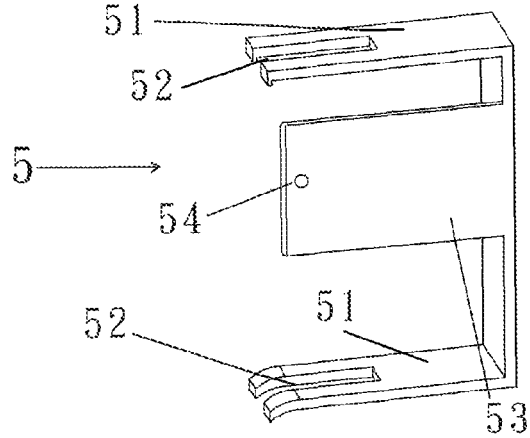
FIG. 7 is a perspective view of another preferred embodiment of the multifunction clothes hanger.
Figure 7:
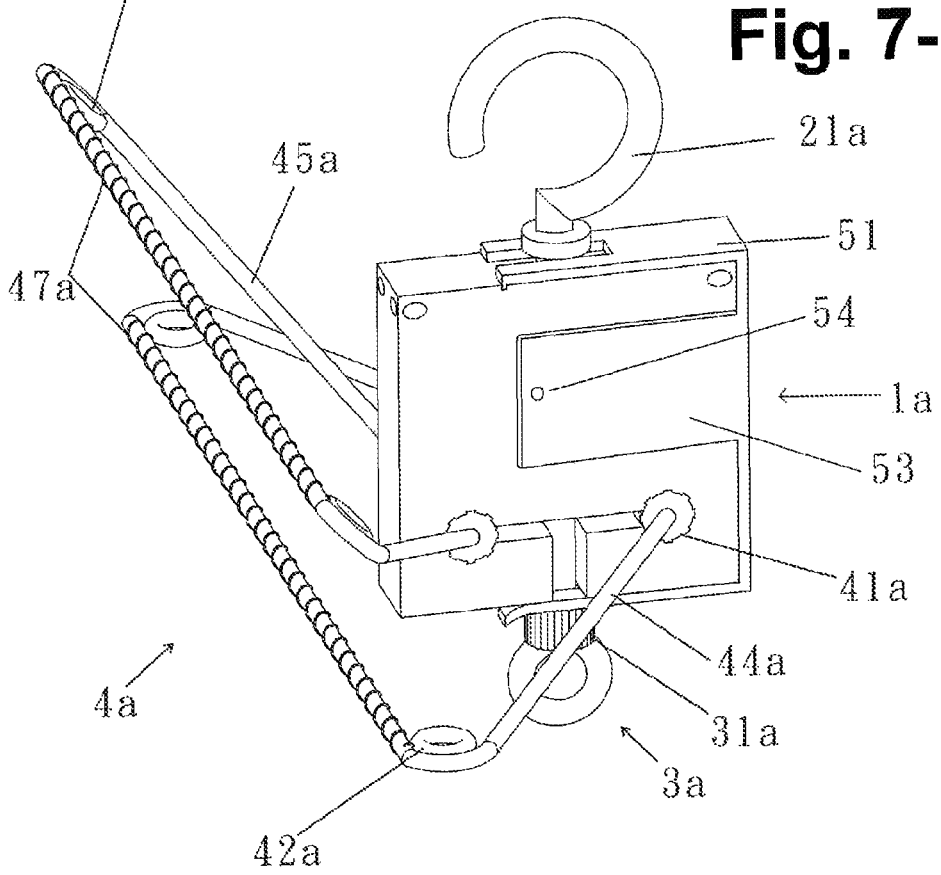

Referring to FIGS. 7 and 7-1, there are shown a perspective view of another preferred embodiment of the multifunction clothes hanger and a schematic view of a fixing base. As shown in the drawings, a further-improved and space-saving multifunction clothes hanger in this preferred embodiment comprises a main body 1*a*, a hook 2*a*, an annular member 3*a*, two clothes hangers 4*a*, and a fixing base 5. Basically, the main body 1*a*, the hook 2*a*, the annular member 3*a*, and two said clothes hangers 4*a* in this embodiment are the same as the main body 1, the hook 2, the annular member 3, and two said clothes hangers 4 in the preceding embodiment in terms of structure, respectively, and thus are not described hereunder in detail for the sake of brevity. In this preferred embodiment, the fixing base 5 comprises upper and lower arms 51, upper and lower grooves 52, left and right baffles 53, and two screw holes 54. The fixing base 5 is C-shaped reversely. Four screw holes (not shown) are disposed on four sides of the bottom of the fixing base 5, respectively. Two screw holes (not shown) are disposed at a middle portion of the fixing base 5. The six screw holes (not shown) are configured to receive screws and enable the fixing base 5 to be fixed in position. As mentioned above, the fixing base 5 comprises the upper and lower arms 51. The upper and lower grooves 52 are formed in the upper and lower arms 51, respectively, in a manner that the upper and lower grooves 52 are each open at one end located at a corresponding one of the free ends of the upper and lower arms 51. The lengthwise extent of the upper and lower grooves 52 lies between the free ends of the upper and lower arms 51 and the middle of the upper and lower arms 51, respectively. The open end of the lower groove 52 dips slightly to facilitate entry (engagement) or exit (withdrawal) of the main body 1*a*. The left and right baffles 53 are disposed on the left and right sides of the fixing base 5, respectively. A screw hole 54 is disposed on each of the left and right baffles 53. After the main body 1*a* has entered the fixing base 5, the main body 1*a* is fixed to the fixing base 5 by means of the screw hole 54. To be specific, the main body 1*a* of the multifunction clothes hanger of the present invention enters the fixing base 5 by passing the upper and lower grooves 52 such that the main body 1*a* becomes engaged with the left and right baffles 53. Afterward, a screw is passed through each screw hole 54 and fixed to the main body 1*a*. As a result of the angular adjustment and the ensuing firm engagement between the protrusion 411 of each of two said clothes hangers 4*a* and the grooves 121, 131 of the main body 1*a*, two said clothes hangers 4*a* can be rotated in a manner that the clothes hangers 4*a* lie on the same side with one above the other, thereby finalizing the multifunction clothes hanger in a preferred embodiment. Accordingly, the multifunction clothes hanger of the present invention minimizes the space required for the sun drying or air drying of clothes. Furthermore, the multifunction clothes hanger of the present invention comes in different sizes, such as large, medium, and small, such that users can use vertical 3D space as needed to thereby make good use of limited space.

What is claimed is:

1. A multifunction clothes hanger comprising a main body, a hook, an annular member and two clothes hangers;

said main body being a hexahedron, comprising:

a straight through-hole being centrally disposed in the main body to penetrate the main body from the top of the main body to the bottom thereof;

left and right through-holes being disposed in the main body;

grooves being disposed on the inner sides of the left and right through-holes, respectively;

a T-shaped through-groove extending from the bottom of the straight through-hole of the main body to between the left and right through-holes; and four through-holes disposed at the upper end of left and right sides of the main body, respectively, wherein each of said through-holes penetrates the main body from a side thereof to an adjoining side;

said hook having:

a curved crotchet disposed at the upper end of the hook; and a thread disposed at the bottom of the hook;

said annular member being a ring-shaped body which is capable of free rotation and angular adjustment, wherein a screw nut is disposed on the top of the ring-shaped body;

each of said clothes hangers comprising:

a cylindrical body disposed between two slope portions of each of said clothes hangers, wherein a protrusion is disposed on the outer surface of the cylindrical body;

two rings disposed at two corners between a base side and two said slope portions of each of said clothes hangers, respectively; and a resilient cord, wherein one end of said resilient cord is fixed to one of two said rings;

wherein the protrusion of the cylindrical body of each of said clothes hangers enters the T-shaped through-groove at the bottom of the main body, moves along the T-shaped through-groove to reach the upper portion of the T-shaped through-groove, and moves into the transverse portion of the T-shaped through-groove to enter the left and right through-holes, thereby said protrusion being engaged with said grooves disposed on the inner sides of the left and right through-holes; furthermore, said hook being inserted into said straight through-hole at the upper portion of the main body until said thread of the hook reaching the bottom of the main body to engage with said screw nut of the annular member so as to assemble the multifunction clothes hanger.

2. The multifunction clothes hanger of claim 1, wherein the protrusion of the cylindrical body of each of said clothes hangers is engaged with the grooves disposed on the inner sides of said left and right through-holes, respectively; therefore, two said clothes hangers can be stretched and spread to be positioned at an appropriate angle as needed, such that two said clothes hangers have access to sufficient ventilation space and thereby speed up the sun drying or air drying of articles.

3. The multifunction clothes hanger of claim 1, wherein the resilient cord is fixed to one of two said rings, extended along the base side while winding around the base side to reach the other one of two said rings, and fastened to the other one of two said rings so as to render the resilient cord taut;

therefore, personal paraphernalia and smaller articles can be held by the resilient cord winding around the base side and thereby hung on the base side for sun drying or air drying.

4. The multifunction clothes hanger of claim 1, wherein a portion of the resilient cord is fastened to one of two said rings and the other portion of the resilient cord is slackened, such that the other portion of the resilient cord fastened to the other one of two said rings no longer winds around the base side; therefore, the multifunction clothes hanger is useful in sun drying or air drying large articles, which are heavy and thus likely to droop or fall, and the slackened and unwinding portion of the resilient cord is pulled toward the through-holes of the main body, and fastened to the through-holes before the resilient cord is pulled toward the other one of two said rings to fix the large articles to the multifunction clothes hanger for stable sun drying or air drying.

5. A multifunction clothes hanger comprising a main body, a hook, an annular member, two clothes hangers and a fixing base;

said main body being a hexahedron, having:

a straight through-hole being centrally disposed in the main body to penetrate the main body from the top of the main body to the bottom thereof;

left and right through-holes being disposed in the main body;

grooves being disposed on the inner sides of the left and right through-holes, respectively;

a T-shaped through-groove extending from the bottom of the straight through-hole of the main body to between the left and right through-holes; and four through-holes disposed at the upper end of left and right sides of the main body, respectively, wherein each of said through-holes penetrates the main body from a side thereof to an adjoining side;

said hook having:

a curved crotchet disposed at the upper end of the hook; and a thread disposed at the bottom of the hook;

said annular member being a ring-shaped body which is capable of free rotation and angular adjustment, wherein a screw nut is disposed on the top of the ring-shaped body;

each of said clothes hangers comprising:

a cylindrical body disposed between two slope portions of each of said clothes hangers, wherein a protrusion is disposed on the outer surface of the cylindrical body;

two rings disposed at two corners between a base side and two said slope portions of each of said clothes hangers, respectively; and a resilient cord, wherein one end of said resilient cord is fixed to one of two said rings;

said fixing base being C-shaped reversely, having:

upper and lower arms disposed on the upper and lower ends of the fixing base;

upper and lower grooves, wherein the open end of the lower groove dips slightly to facilitate entry or exit of the main body;

left and right baffles disposed on the left and right sides of the fixing base, respectively; and two screw holes disposed on the left and right baffles;

wherein after the fixing base is fixed on the wall, the main body assembled with said hook, said annular member and said clothes hangers has entered the fixing base and fixed to the fixing base by means of inserting a screw into the screw holes.

6. The multifunction clothes hanger of claim 5, wherein the protrusion of the cylindrical body of each of said clothes hangers is engaged with the grooves disposed on the inner sides of said left and right through-holes, respectively;

therefore, two said clothes hangers can be rotated in a manner that the clothes hangers lie on the same side with one above the other, thereby minimizing the space required for the sun drying or air drying of clothes, such that users can use vertical 3D space as needed to make good use of limited space.

7. The multifunction clothes hanger of claim 5, wherein the resilient cord is fixed to one of two said rings, extended along the base side while winding around the base side to reach the other one of two said rings, and fastened to the other one of two said rings so as to render the resilient cord taut;

therefore, personal paraphernalia and smaller articles can be held by the resilient cord winding around the base side and thereby hung on the base side for sun drying or air drying.

8. The multifunction clothes hanger of claim 5, wherein one portion of the resilient cord is fastened to one of two said rings and the other portion of the resilient cord is slackened, such that the other portion of the resilient cord fastened to the other one of two said rings no longer winds around the base side; therefore, the multifunction clothes hanger is useful in sun drying or air drying large articles, which are heavy and thus likely to droop or fall, and the slackened and unwinding portion of the resilient cord is pulled toward the through-holes of the main body, and fastened to the through-holes before the resilient cord is pulled toward the other one of two said rings to fix the large articles to the multifunction clothes hanger for stable sun drying or air drying.

* * * * *